US007891731B2

(12) United States Patent
O'Toole

(10) Patent No.: US 7,891,731 B2
(45) Date of Patent: Feb. 22, 2011

(54) DEBRIS COLLECTION SYSTEMS, DEVICES AND METHODS FOR ATTACHMENT TO CHAIRS

(76) Inventor: Thomas Ryan O'Toole, 7161 Cattail, O'Fallon, MO (US) 63368

( * ) Notice: Subject to any disclaimer, the term of this patent is extended or adjusted under 35 U.S.C. 154(b) by 250 days.

(21) Appl. No.: 12/218,849

(22) Filed: Jul. 18, 2008

(65) Prior Publication Data

US 2010/0013277 A1 Jan. 21, 2010

(51) Int. Cl.
*A47D 15/00* (2006.01)

(52) U.S. Cl. ..... 297/182

(58) Field of Classification Search ..... 297/182, 297/188.01, 188.2, 463.2
See application file for complete search history.

(56) References Cited

U.S. PATENT DOCUMENTS

| | | | | | |
|---|---|---|---|---|---|
| 837,570 | A * | 12/1906 | Jackson | 297/182 |
| 2,585,434 | A * | 2/1952 | Caponera | 297/182 |
| 2,607,052 | A * | 8/1952 | Le Roy | 5/93.1 |
| 2,700,413 | A * | 1/1955 | Williams | 297/182 |
| 2,827,953 | A * | 3/1958 | Jones | 297/182 |
| 2,938,574 | A * | 5/1960 | Brown | 297/182 |
| 3,298,736 | A * | 1/1967 | Decker | 297/182 |
| 4,165,123 | A | 8/1979 | Hutson | |
| 4,298,228 | A | 11/1981 | Zampino et al. | |
| 4,659,143 | A | 4/1987 | MacLennan | |
| 4,848,834 | A | 7/1989 | Linski | |
| 4,887,315 | A | 12/1989 | Bezdek | |
| 4,955,666 | A | 9/1990 | Baker | |
| 5,188,421 | A | 2/1993 | Arseneault | |
| 5,660,432 | A | 8/1997 | Davis | |
| 6,532,595 | B1 * | 3/2003 | Holmes | 2/48 |
| 6,652,947 | B2 * | 11/2003 | Sweeney et al. | 428/43 |
| 6,796,606 | B2 | 9/2004 | Marshall | |

* cited by examiner

*Primary Examiner*—Peter R. Brown

(57) ABSTRACT

A debris collection system includes a collection device configured to be coupled to legs of a chair. The collection device has an open top end and a bottom end and a plurality segments coupled to one another. Each segment includes a fastening mechanism, wherein the fastening mechanisms of adjacent segments are coupled to one another such that one of the legs of the chair extends between the fastening mechanisms of the adjacent segments. Optionally, the collection device may have a frusto-conical shape. The bottom end may be open and debris collected by the collection device may be channeled by the collection device through the open bottom end. Optionally, a container may be positioned below the open bottom end to collect debris directed through the open bottom end. The collection device may have a funnel shape with walls that taper inward from the top end to the bottom end. Each of the segments may be substantially identically formed to define the collection device.

13 Claims, 8 Drawing Sheets

DEBRIS COLLECTION SYSTEMS, DEVICES AND METHODS FOR ATTACHMENT TO CHAIRS

BACKGROUND OF THE INVENTION

The subject matter herein relates generally to debris collection systems, devices and methods, and more particularly, to debris collection systems, devices and methods for attachment to chairs and/or high chairs.

Infants spill, throw and drop food and objects when in a high chair or seated at a table. Parents and others face an ongoing task of cleaning these items, usually on the floor. A common way to protect the floor is to place a mat or sheet under the child and chair. Cleaning this mat or sheet, however, still takes considerable effort.

Another method of dealing with the debris deals with attachments to the chair. Many of these devices, however, only catch debris that has fallen in a certain place, and even when the debris is caught, cleaning of that catch area still needs to take place. Further, often the attachments are either permanently attached, specific to a type or design of chair, or bulky and cumbersome.

A need remains for a device for attaching to a high chair or chair for catching thrown or dropped debris. A need remains for a device used to funnel dropped debris into a smaller receptacle for easy removal. A need remains for a device that may be adjustable to a number of different chair styles and sizes. A need remains for a device that is removable, lightweight and foldable such as to take up little storage space.

BRIEF DESCRIPTION OF THE INVENTION

In one embodiment, a debris collection system is provided including a collection device configured to be coupled to legs of a chair. The collection device has an open top end and a bottom end and a plurality of segments coupled to one another. Each segment includes a fastening mechanism, wherein the fastening mechanisms of adjacent segments are coupled to one another such that one of the legs of the chair extends between the fastening mechanisms of the adjacent segments.

Optionally, the collection device may have a frusto-conical shape. The bottom end may be open and debris collected by the collection device may be channeled by the collection device through the open bottom end. Optionally, a container may be positioned below the open bottom end to collect debris directed through the open bottom end. The collection device may have a funnel shape with walls that taper inward from the top end to the bottom end. Each of the segments may be substantially identically formed to define the collection device. The segments may include opposed sides extending between an inner end and an outer end, wherein the outer end has a length that is longer than a length of the inner end. The outer end may being curved between the opposed sides to define an arc length. The inner end may also be curved between the opposed sides to define an arc length. The arc length of the inner end is less than the arc length of the outer end.

Optionally, each segment may include a fastening mechanism extending along each side thereof. The fastening mechanisms may extend along substantially an entire length of each side. The fastening mechanisms of adjacent segments may couple corresponding sides of the segments to one another. The sides may abut one another along the length of the sides except for portions of the sides proximate the legs of the chairs, wherein the sides are separated to allow the legs to pass through the collection device. Optionally, the fastening mechanisms may be hook and loop fasteners.

In another embodiment, a debris collection device is provided including first, second, third and fourth segments coupled to one another to form a funnel configured to circumferentially surround a chair. Each segment includes opposed sides extending between an inner end and an outer end, wherein the outer end is curved between the opposed sides to define an arc length. A fastening mechanism extends along each side of each segment, wherein the fastening mechanisms of adjacent segments cooperate to coupled adjacent segments to one another. The fastening mechanisms of adjacent segments are configured to surround a leg of the chair to allow the leg of the chair to extend through the debris collection device.

In a further embodiment, a method of forming a debris collection device is provided that includes providing first, second, third and fourth segments, wherein each of the segments are substantially identically formed and include opposed sides extending between an inner end and an outer end, and wherein the segments each include fastening mechanisms along each side of each of the segments. The method also includes coupling one of the fastening mechanisms of the first segment to one of the fastening mechanisms of the second segment such that a first leg of a chair extends between the first and second segments, coupling the other of the fastening mechanisms of the second segment to one of the fastening mechanisms of the third segment such that a second leg of the chair extends between the second and third segments, coupling the other of the fastening mechanisms of the third segment to one of the fastening mechanisms of the fourth segment such that a third leg of the chair extends between the third and fourth segments, and coupling the other of the fastening mechanisms of the fourth segment to the other of the fastening mechanisms of the first segment such that a fourth leg of the chair extends between the first and second segments.

DETAILED DESCRIPTION OF THE INVENTION

Figure 1:
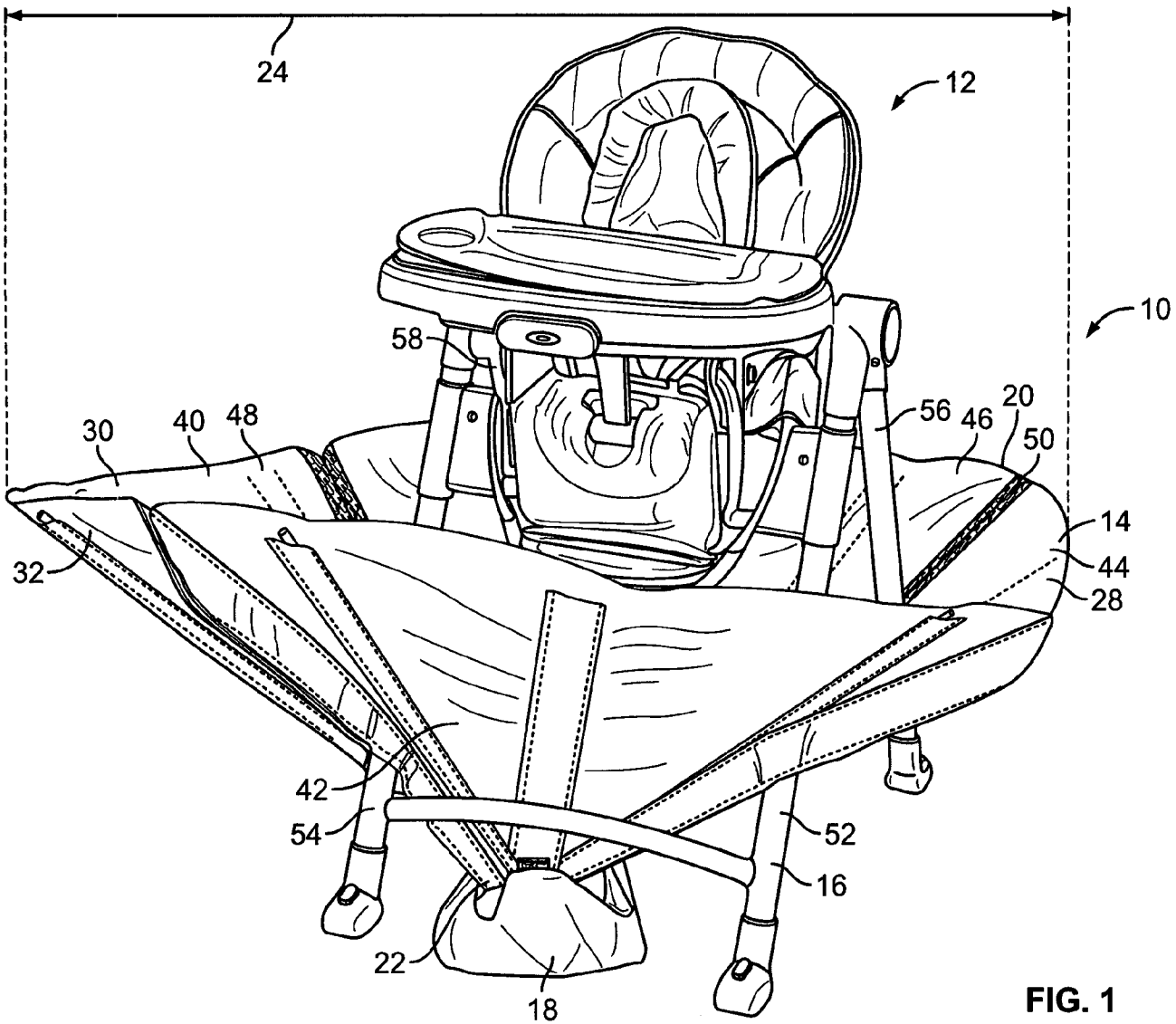
FIG. 1 is a perspective view of an exemplary debris collection system for use with a chair.

FIG. 1 is a perspective view of an exemplary debris collection system 10 for use with a chair 12. In an exemplary embodiment, the debris collection system 10 includes a collection device 14 coupled to legs 16 of the chair 12, and a container 18 provided generally below the collection device 14. The container 18 may be coupled to the collection device 14 to collect any debris that is received in the collection device 14. In alternative embodiments, the debris collection system 10 may be utilized without the container 18. The debris collection system 10 is configured for use with any type and/or style of chair, however the debris collection system 10 is well suited for use with high chairs or other types of chairs that are used by infants, toddlers and/or children to collect debris, such as food, liquids, toys or other objects spilled or lost by the child. As such, while a high chair is illustrated in the figures, the high chair is merely illustrative of one type of chair on which the debris collection system 10 may be mounted, and the debris collection system is not intended to be restricted to mounting on high chairs.

In an exemplary embodiment, the collection device 14 extends between a top end 20 and a bottom end 22. The top end 20 is open and receives debris spilled from the chair 12. In the illustrated embodiment, the top end 20 is generally circular, however other shapes are possible in alternative embodiments. The top end 20 has a diameter 24 that is generally larger than the size of the chair 12. The diameter 24 may be sized generally larger than a typical wingspan of a child such that items dropped from the child's hands may fall directly into the collection device 14. When mounted to the chair 12, the top end 20 may be positioned generally flush or planar with a tray of the chair 12. Alternatively, the top end 20 may be positioned substantially planar with a seat of the chair 12. The top end 20 may be positioned at other heights relative to the chair, such as above the tray or seat, or below the tray or seat. Optionally, as described in further detail below, the vertical positioning of the top end 20 may be controlled and/or changed depending on the preference of the user. For example, for a given chair, a range of positions of the vertical height of the collection device may be selected.

The bottom end 22 is open and funnels and/or dispels the debris collected by the collection device 14. In the illustrated embodiment, the bottom end 22 is generally circular, however other shapes are possible in alternative embodiments. The bottom end 22 has a diameter 26 (shown in FIG. 6) that is generally smaller than the diameter 24 of the top end 20. The container 18 is positioned generally bellow the bottom end 22 to collect the debris.

The collection device 14 includes walls 28 defining an interior 30 and an exterior 32. The walls 28 are oriented such that collection device 14 has a funnel shape. The debris collecting by the collection device 14 may thus be funneled toward the bottom end 22 and ultimately collected by the container 18. In an exemplary embodiment, the walls 28 taper inward from the top end 20 to the bottom end 22. The inward taper provides a funnel action for the debris collected by the collection device 14. In an exemplary embodiment, the collection device 14 has a frustoconical shape.

The collection device 14 includes a plurality of segments 40. The segments are joined to one another to form the collection device 14. In the illustrated embodiment, the collection device 14 includes a first segment 42, a second segment 44, a third segment 46 and a fourth segment 48. While four segments 40 are shown, it is realized that the collection device 14 may have any number of segments 40. In an exemplary embodiment, the segments 40 are separately provided from one another and coupled to one another. Alternatively, at least portions of the segments 40 may be integrally formed with one another, such as proximate the top end 20 or proximate the bottom end 22.

In an exemplary embodiment, the collection device 14 includes a plurality of fastening mechanisms 50 that couple the segments to one another at an interface. The interface defines a seam and may define a separable interface. The fastening mechanisms 50 are configured to be repeatedly fastened and unfastened such that the collection device 14 may be reusable and removed from the chair when not in use. In an exemplary embodiment, the fastening mechanisms 50 are hook and loop fasteners, however other types of fasteners may be used to couple the segments 40 to one another.

During assembly, the segments 40 are successively coupled to one another such that the collection device 14 is positioned with respect to the chair 12 and the legs 16 of the chair 12. In the illustrated embodiment, four legs 16 are provided that define front legs 52, 54 and rear legs 56, 58. The legs 52, 56 are provided on a first side of the chair 12 and the legs 54, 58 are provided on the other side of the chair 12. During assembly, the first segment 42 is positioned at the front of the chair 12 generally between the front legs 52, 54. The second segment 44 is positioned between the legs 52, 56 on the first side of the chair 12. The second segment 44 is coupled to the first segment 42 using fastening mechanisms 50, such as a first fastening mechanism 50 on the first segment 42 and a second fastening mechanism 50 on the second segment 44.

The first and second segments 42, 44 are coupled to one another such that the first leg 52 extends between the first and second segments 42, 44. In other words, the first leg 52 passes through the collection device 14 at the seam created by the interface of the first and second segments 42, 44. In an exemplary embodiment, the fastening mechanisms 50 couple the first and second segments to one another both above and below the first leg 52. For example, at least a portion of the interface between the first and second segments 42, 44 is above and outward from the first leg 52 and at least a portion of the interface between the first and second segments 42, 44 is below and inward from the first leg 52.

The third segment 46 is coupled to the second segment 44 in a similar manner. For example, the third segment 46 is positioned between the rear legs 56, 58. The third segment 46 is coupled to the second segment 44 using fastening mechanisms 50. The second and third segments 44, 46 are coupled to one another such that the third leg 56 extends between the second and third segments 44, 46.

The fourth segment 48 is coupled to the first and third segments 42, 46 in a similar manner. For example, the fourth segment 48 is positioned between the side legs 54, 58. The fourth segment 48 bridges the gap between the first and third segments 42, 46. The fourth segment 48 is coupled to the first and third segments 42, 46 using fastening mechanisms 50. The third and fourth segments 46, 48 are coupled to one another such that the fourth leg 58 extends between the third and fourth segments 46, 48. The first and fourth segments 42, 48 are coupled to one another such that the second leg 54 extends between the first and fourth segments 46, 48.

Figure 2:
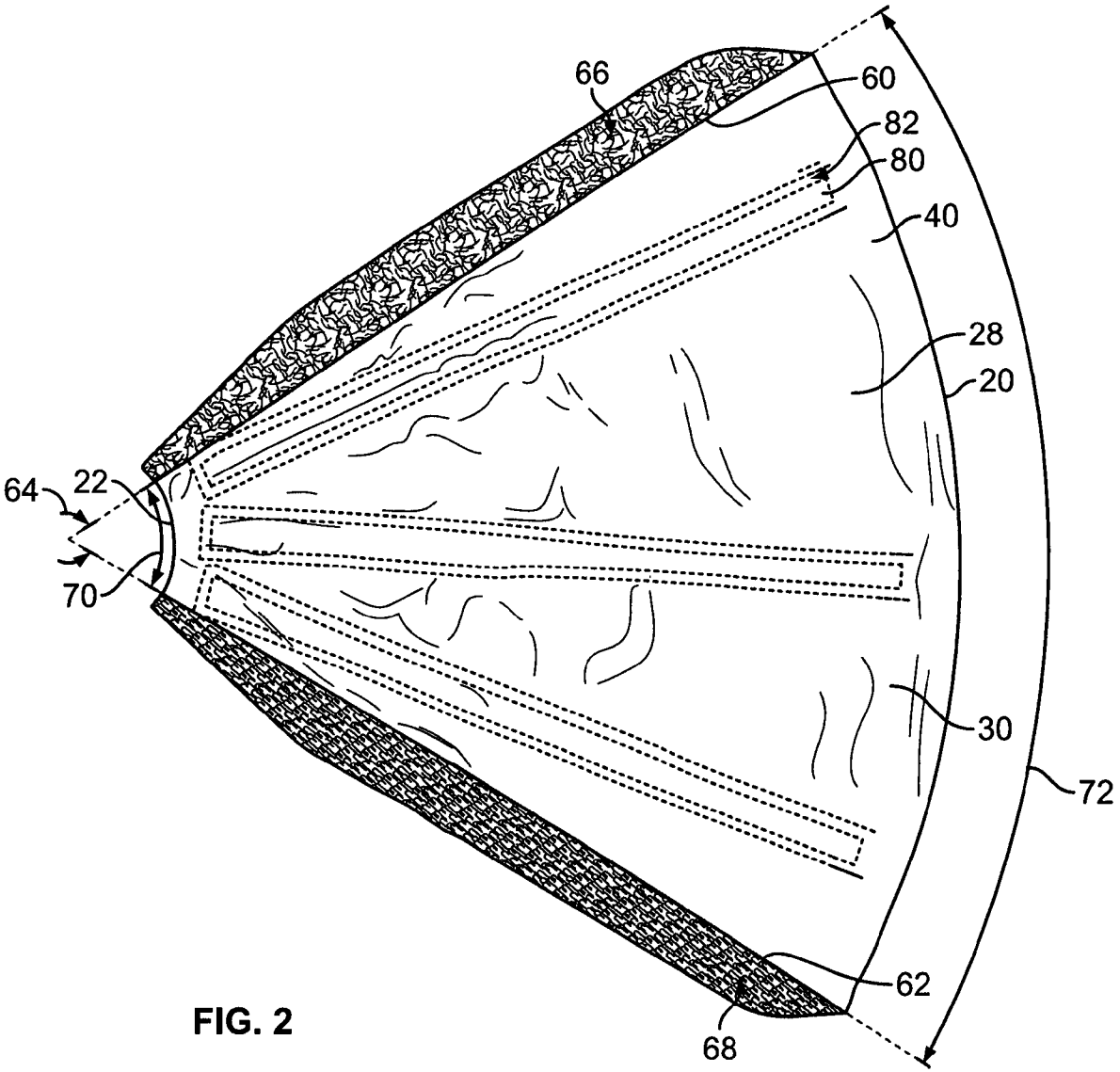
FIG. 2 is a top view of a segment used to form a debris collection device of the system shown in FIG. 1.

FIG. 2 is a top view of a segment 40 used to form the debris collection device 14 (shown in FIG. 1) of the system 10 (shown in FIG. 1). The segment 40 includes the wall or body 28 that extends between the top end 20 and the bottom end 22. FIG. 2 illustrates the interior 30 of the wall 28. The wall 28 includes opposed sides 60, 62 that extend between the top and bottom ends 20, 22. In an exemplary embodiment the wall 28 may be fabricated from a synthetic material, such as a plastic or vinyl material. Optionally, the wall 28 may be sufficiently flexible to allow some flexing or forming into a desired shape or curvature during assembly. Optionally, the wall 28 may be sufficiently rigid to substantially hold a shape once positioned and assembled to the chair 12 (shown in FIG. 1). The wall 28 may be fabricated from a material that does not absorb liquid or moisture. The wall 28 may be fabricated from a material that has a coefficient of friction low enough that debris contacting the wall may be able to slide down the wall 28 toward the bottom end 22.

The sides 60, 62 extend radially outward from the bottom end 22 which also defines an inner end 22 of the segment 40. The sides 60, 62 extend radially outward to the top end 20 which also defines an outer end 20 of the segment 40. The sides 60, 62 are non-parallel to one another. The sides 60, 62 are angled with respect to one another by an angle 64. The angle 64 may be any angle. In the illustrated embodiment, the angle 64 is an acute angle. The angle 64 may be approximately sixty degrees. However, the angle 64 may be more or less than sixty degrees in alternative embodiments. Optionally, the angle 64 may be a right angle. The angle 64 may be an obtuse angle. In an exemplary embodiment, the sides 60, 62 are generally straight or linear between the inner and outer ends 20, 22.

A first fastening mechanism 66 is attached to the first side 60 and a second fastening mechanism 68 is attached to the second side 62. Optionally, the fastening mechanisms 66, 68 may be applied to the interior 30 of the wall 28 at the respective sides 60, 62. Alternatively, the fastening mechanisms 66, 68 may be separately provided and attached to the segment 40 along the sides 60, 62. In the illustrated embodiment, the first fastening mechanism 66 represents a hook fastener and the second fastening mechanism 68 represents a loop fastener. The fastening mechanisms 66, 68 may extend substantially an entire length of the sides 60, 62 or alternatively may extend only partially between the inner and outer ends 20, 22.

In an exemplary embodiment, the inner end 22 is outwardly radiused or curved. The inner end 22 defines an arc length 70 between the sides 60, 62. Similarly, the outer end 20 is radiused or curved. The outer end 20 defines an arc length 72 between the sides 60, 62 that is greater than the arc length 70 of the inner end 22. In an alternative embodiment, the inner end 22 may come to a point. In such embodiments, the bottom end 22 of the collection device 14 (shown in FIG. 1) may be closed. In other alternative embodiments, the inner end 22 and/or the outer end 20 may be substantially linear, inwardly curved, or have an irregular shape.

The segment 40 may include a plurality of strengthening ribs 80 that strengthen the wall 28. The strengthening ribs 80 may reinforce or otherwise help the wall 28 retain a shape when assembled. The strengthening ribs 80 may be received in pockets 80. The strengthening ribs 80 may be removed or removable from the pockets, such as to allow cleaning and/or storage of the segment 40. In alternative embodiments, the strengthening ribs may be embedded within the wall, such as between the interior 30 and the exterior 32 (shown in FIG. 1). The strengthening ribs 80 may be attached to the wall 28 by other means or fasteners, such as hook and loop fasteners, sleeves on the wall 28, loops on the wall 28, and the like. In an exemplary embodiment, the strengthening ribs 80 are secured or accessible on or through the exterior 32.

Figure 3:
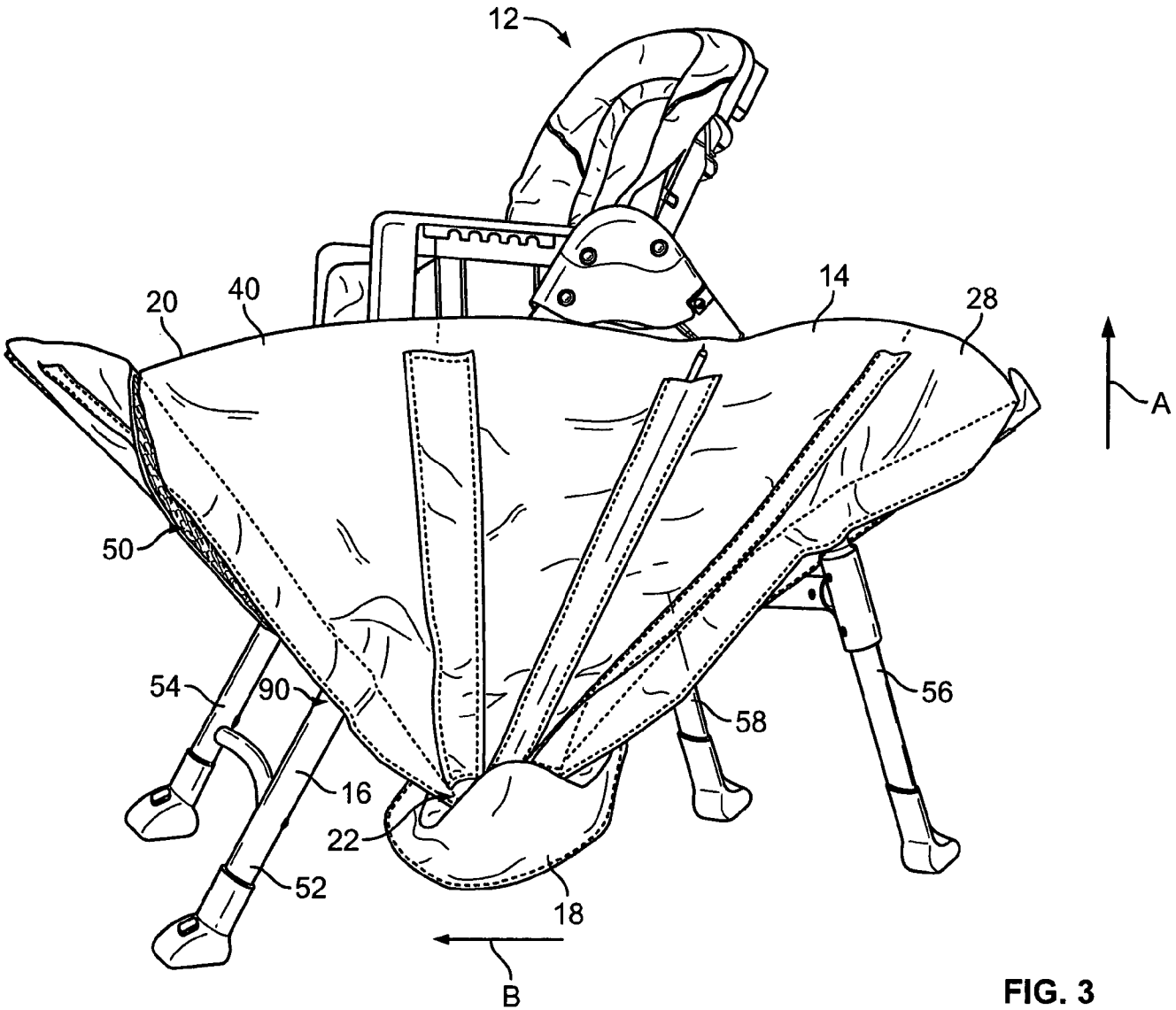
FIG. 3 illustrates the debris collection device attached to the chair shown in FIG. 1 in a different mounting location with respect to the chair.

FIG. 3 illustrates the debris collection device 14 attached to the chair 12 in a different mounting location with respect to the chair than illustrated in FIG. 1. FIG. 1 illustrated the collection device 14 such that the top end 20 was generally below the seat of the chair 12. The container 18 was positioned proximate the ground. FIG. 3 illustrates the collection device 14 positioned relatively higher on the chair 12. For example, the top end 20 is generally above the seat level. The fastening mechanisms 50 allow the collection device 14 to be mounted at various locations (e.g. vertical positions and/or horizontal positions) of the chair 12. For example, in embodiments utilizing the hook and loop fasteners, the legs 16 may pass through the seam created between the segments 40 at virtually any portion of the length of the interface.

In the embodiment illustrated in FIG. 3, the collection device 14 may be positioned higher, shown by the arrow A, by passing the legs 16 between the segments 40 closer to the bottom end 22 (e.g. as the collection device 14 is lifted higher, the legs pass between the segments relatively closer to the center of the collection device). By way of further example, the collection device 14 may be more forwardly positioned, shown by the arrow B, by sliding the collection device relatively forward of the position illustrated prior to attaching the fastening mechanisms 50 to one another. The front legs 52, 54 would be more closely positioned to the center or bottom end 22 and the rear legs 56, 58 would be more closely positioned to the outside or top end 20.

When assembled, the collection device 14 is generally supported by the legs 16 of the chair 12. For example, the splayed configuration of the legs 16 provides a resting surface 90 on the upward facing surface of each leg 16. The fastening mechanisms 50 rest upon the resting surface 90. Additionally, because the legs 16 are splayed outward from one another, legs 16 on opposite sides tend to restrict sliding of the collection device 14 down each respective leg 16. For example, the rearward angling of the rear legs 56, 58 restrict sliding in the forward direction down the front legs 52, 54, and vice versa.

FIG. 3 also illustrates the container 18 coupled to the collection device 14. The container 18 may be fabricated from the same or a similar material as the walls 28 of the collection device 14. The container 18 may be coupled to the collection device using fastening mechanisms, such as hook and loop fasteners. However other attachment means or fasteners may be used. In an exemplary embodiment, the container 18 is flexible and may define a bag for collecting the debris. Alternatively, the container 18 may be rigid and define a cup or bowl for collecting the debris. The container 18 may be removable from the collection device 14.

Figure 4:
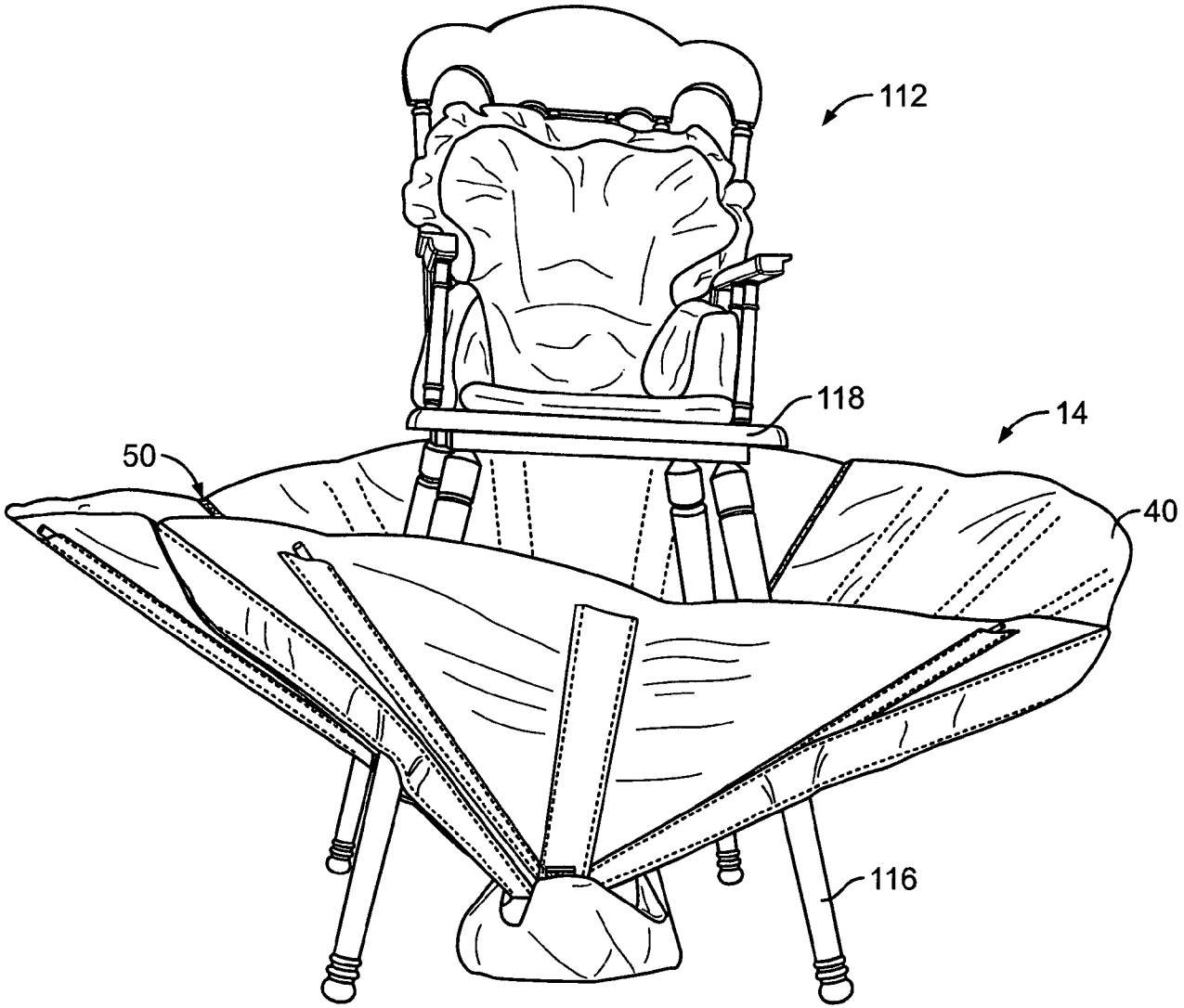
FIG. 4 illustrates the debris collection device attached to a different chair.

FIG. 4 illustrates the debris collection device 14 attached to a different chair 112. The chair 112 has different leg diameters than the chair 12 (shown in FIG. 1). The chair 112 has legs 116 that extend from a seat 118 in different directions and at different angles than the legs 16 (shown in FIG. 1) of the chair 12. The collection device 14 is capable of attaching to the chair 112 in a similar manner as the chair 12. The design of the collection device 14, including the segments 40 and the fastening mechanisms 50 accommodates the different chair 12. For example, the collection device 14 is mountable to the chair 112 even though the legs 116 are at different angles, and even though the legs 116 have different spacing, than the legs 16 of the chair 12.

Figure 5:
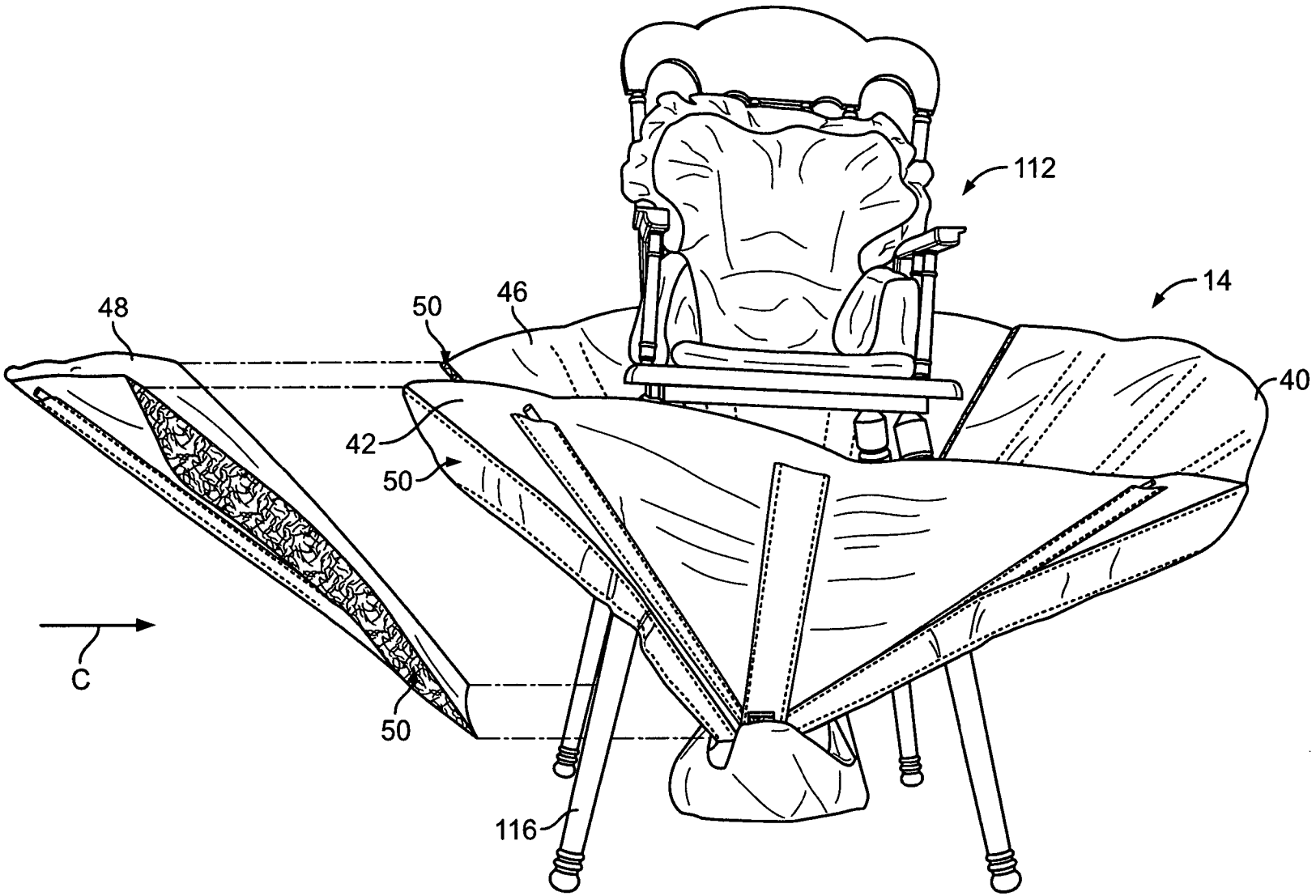
FIG. 5 is an exploded view of the debris collection device shown in FIG. 4, illustrating one of the segments during assembly of the debris collection device.

FIG. 5 is an exploded view of the debris collection device 14 illustrating assembly of the fourth segment 48 with the other segments 40 of the debris collection device 14. The fourth segment 48 is illustrated as being coupled to the first and third segments 42, 46. The fourth segment 48 is brought toward the chair 112 in a mating direction, shown by arrow C. The fastening mechanisms 50 on the fourth segment 48 are flared outward, as are the fastening mechanisms 50 on the first and third segments 42, 46. The first segment 42 is positioned adjacent one of the legs 116, and the fastening mechanism 50 of the first segment extends along the leg 116. When the fourth segment 48 is coupled to the first segment 42, the leg 116 will pass through the fastening mechanisms 50 between the segments 42, 46. Adjacent segments 40 operate to support one another on the legs 116.

FIG. 5 also illustrates the collection device 14 at a different mounting location with respect to the mounting location shown in FIG. 4. For example, FIG. 5 shown the collection device mounted higher than in the embodiment of FIG. 4.

Figure 6:
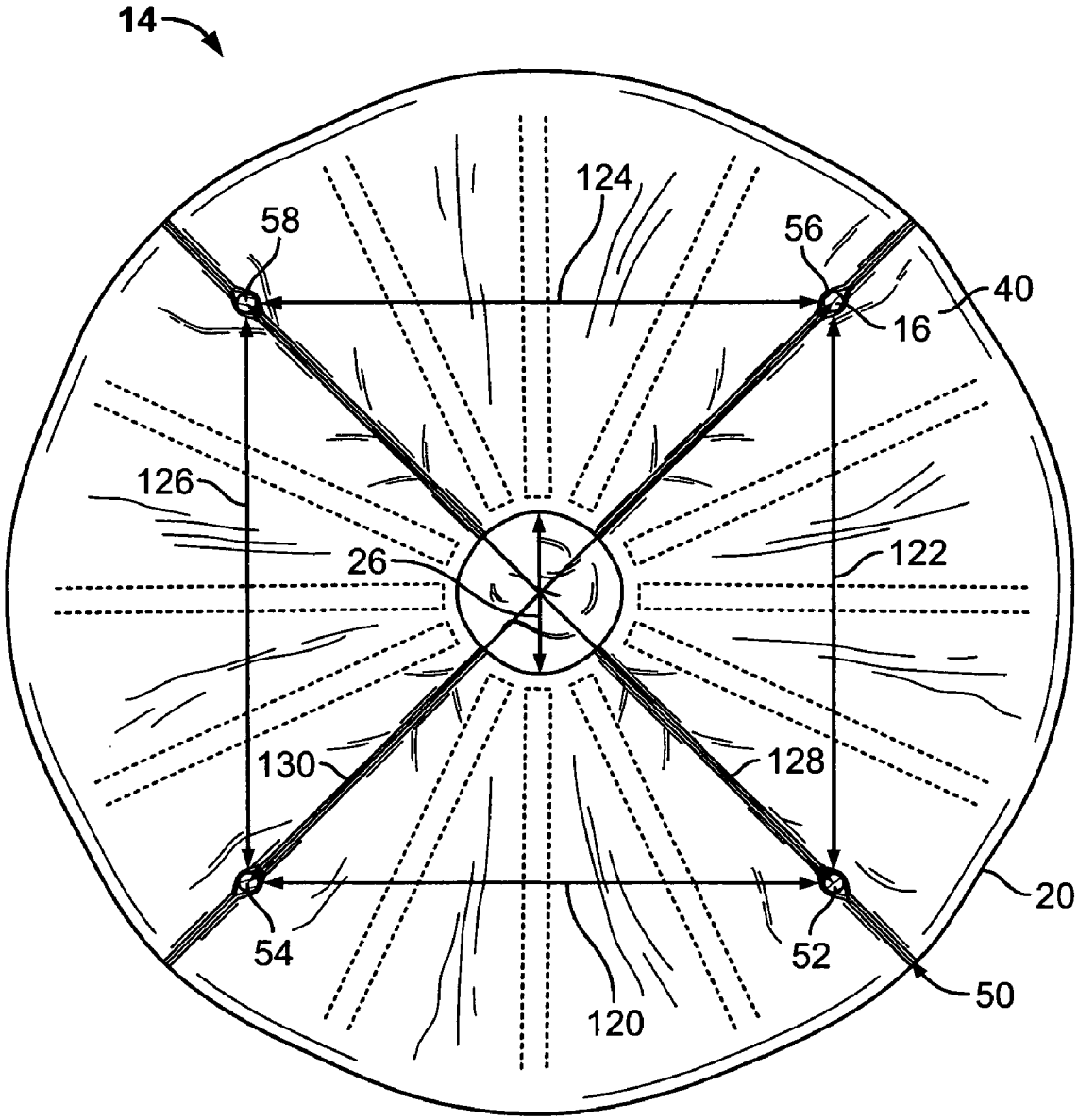
FIG. 6 is a top view of the debris collection device.

FIG. 6 is a top view of the debris collection device 14 and illustrates the legs 16 passing between adjacent segments 40. As illustrated, the fastening mechanisms 50 are secured to one another on either side of the respective legs 16 (e.g. radially inward and radially outward with respect to the leg 16). The legs 16 are illustrated as being more closely positioned to the outer end 20 of the segments 40. For example, the first and second legs 52, 54 are separated from one another by a distance 120. The first and third legs 52, 56 are separated from one another by a distance 122. The third and fourth legs 56, 58 are separated from one another by a distance 124. The second and fourth legs 54, 58 are separated from one another by a distance 126. The first and fourth legs 52, 58 are separated from one another by a distance 128. The second and third legs 54, 56 are separated from one another by a distance 130.

Figure 7:
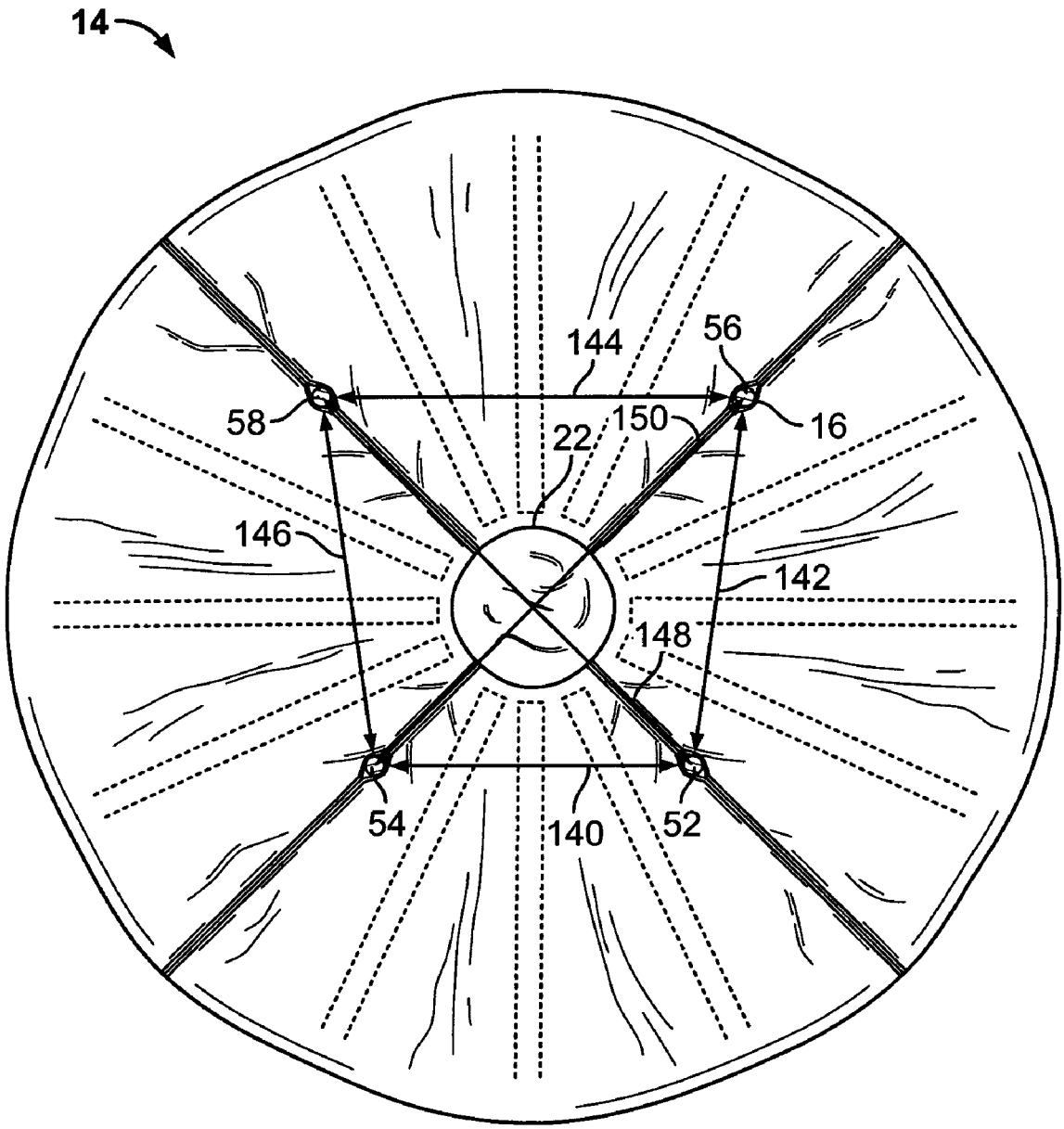
FIG. 7 is a top view of the debris collection device shown in FIG. 6 in a different mounting orientation with respect to the chair.

FIG. 7 is a top view of the debris collection device 14 in a different mounting orientation with respect to the legs 16. In the embodiment of FIG. 7, the mounting location of the legs 16 with respect to the collection device 14, the legs 16 are more closely positioned to the inner end 22 of the segments 40. Such an arrangement is different than the arrangement of the embodiment shown in FIG. 6. For example, the first and second legs 52, 54 are separated from one another by a distance 140, which is less than the distance 120. The first and third legs 52, 56 are separated from one another by a distance 142, which is less than the distance 122. The third and fourth legs 56, 58 are separated from one another by a distance 144, which is less than the distance 124. The second and fourth legs 54, 58 are separated from one another by a distance 146, which is less than the distance 126. The first and fourth legs 52, 58 are separated from one another by a distance 148, which is less than the distance 128. The second and third legs 54, 56 are separated from one another by a distance 150, which is less than the distance 130.

Figure 8:
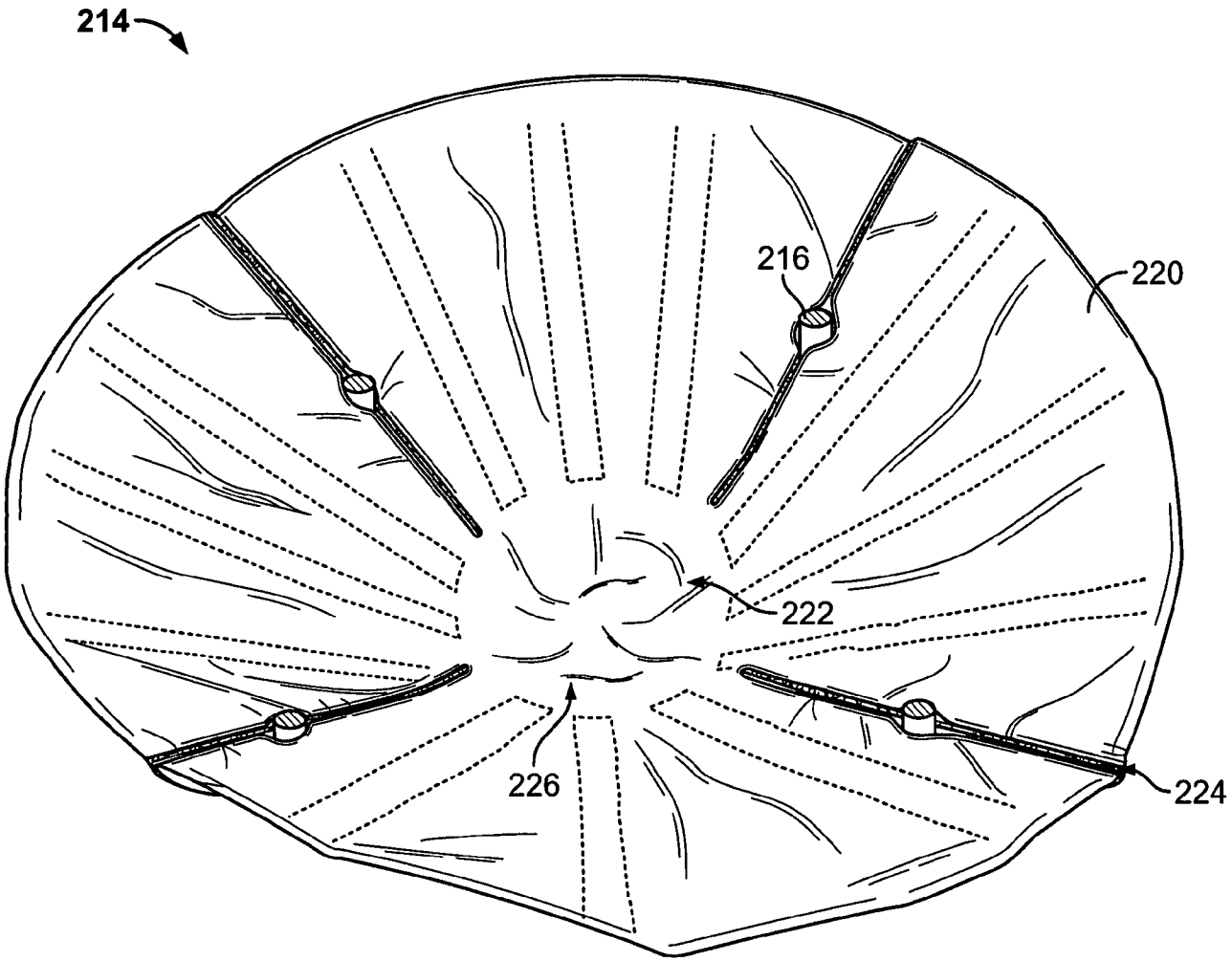
FIG. 8 is a perspective view of an alternative debris collection device.

FIG. 8 is a perspective view of an alternative debris collection device 214 mounted to legs 216 of a chair (not shown). The collection device 214 is similar to the collection device 14 (shown in FIG. 1). The collection device 214 includes a plurality of segments 220. In contrast to the collection device 14, the segments 220 are integrally formed with one another at a central hub 222. The segments 220 thus define flaps or wings that extend outward from the hub 222 and may be attached to one another. For example, each of the segments 220 include fastening mechanisms 224, such as hook and loop fasteners, that can be attached to one another. The segments 220 may be connected to one another around the legs 216 which are able to pass between the segments 220. Once assembled, the collection device 214 forms a container area 226 at the central hub 222. For example, the collection device 214 forms a funnel that funnels debris toward the center. Once in the collection device 214, the debris can be easily collected and discarded.

In an alternative embodiment, rather than being connected at the central hub 222, the segments may be connected to one another about the outer perimeter of the collection device 214. The segments may be connected to one another and direct debris toward the center. In such an embodiment, the center portion may include an opening for funneling the debris into a separate container.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A debris collection system comprising:

a collection device configured to be coupled to legs of a chair, the device having an open top end and a bottom end, the collection device having a plurality of segments coupled to one another, each segment includes a fastening mechanism, wherein the fastening mechanisms of adjacent segments are coupled to one another such that one of the legs of the chair extends between the fastening mechanisms of the adjacent segments, wherein each segment includes opposed sides extending between an inner end and an outer end, each segment including a fastening mechanism extending along each side thereof, wherein the sides abut one another along the length of the sides except for portions of the sides proximate the legs of the chairs, wherein the sides are separated to allow the legs to pass through the collection device.

2. The debris collection system of claim 1, wherein the collection device has a frustro-conical shape.

3. The debris collection system of claim 1, wherein the bottom end is open and debris collected by the collection device is channeled by the collection device through the open bottom end.

4. The debris collection system of claim 3, further comprising a container configured to be positioned below the open bottom end to collect debris directed through the open bottom end.

5. The debris collection system of claim 1, wherein the collection device has a funnel shape with walls that taper inward from the top end to the bottom end.

6. The debris collection system of claim 1, wherein each of the segments are substantially identically formed to define the collection device.

7. The debris collection system of claim 1, wherein each of the segments include opposed sides extending between an inner end and an outer end, the outer end having a length that is longer than a length of the inner end.

8. The debris collection system of claim 1, wherein each of the segments include opposed sides extending between an inner end and an outer end, the outer end being curved between the opposed sides to define an arc length.

9. The debris collection system of claim 8, wherein the inner end is curved between the opposed sides to define an arc length, the arc length of the inner end being less than the arc length of the outer end.

10. The debris collection system of claim 1, further comprising strengthening ribs coupled to the collection device.

11. The debris collection system of claim 1, wherein the fastening mechanisms extend substantially an entire length of each side.

12. The debris collection system of claim 1, wherein the fastening mechanisms of adjacent segments couple corresponding sides of the segments to one another.

13. The debris collection system of claim 1, wherein the fastening mechanisms comprise hook and loop fasteners.

* * * * *